US010783747B2

(12) United States Patent
Lamb et al.

(10) Patent No.: US 10,783,747 B2
(45) Date of Patent: Sep. 22, 2020

(54) GAMING SYSTEMS AND METHODS UTILIZING MULTI-MODE GAME ELEMENTS

(71) Applicant: KING SHOW GAMES, INC., Minnetonka, MN (US)

(72) Inventors: Jacob Lamb, Maple Grove, MN (US); Anthony Grotte, Buffalo, MN (US)

( * ) Notice: Subject to any disclaimer, the term of this patent is extended or adjusted under 35 U.S.C. 154(b) by 224 days.

(21) Appl. No.: 15/807,013

(22) Filed: Nov. 8, 2017

(65) Prior Publication Data

US 2018/0130299 A1 May 10, 2018

Related U.S. Application Data

(60) Provisional application No. 62/419,437, filed on Nov. 8, 2016.

(51) Int. Cl.

| | |
|---|---|
| ***G07F 17/00*** | (2006.01) |
| ***G07F 19/00*** | (2006.01) |
| ***G07F 17/32*** | (2006.01) |
| ***G07F 17/34*** | (2006.01) |

(52) U.S. Cl.

CPC ..... *G07F 17/3244* (2013.01); *G07F 17/3209* (2013.01); *G07F 17/3213* (2013.01); *G07F 17/3225* (2013.01); *G07F 17/3241* (2013.01); *G07F 17/34* (2013.01)

(58) Field of Classification Search

CPC ..... G07F 17/3209; G07F 17/3213; G07F 17/3225; G07F 17/3241; G07F 17/3244; G07F 17/326; G07F 17/3262; G07F 17/3265; G07F 17/34

See application file for complete search history.

(56) References Cited

U.S. PATENT DOCUMENTS

| | | | | |
|---|---|---|---|---|
| 7,850,520 | B2 * | 12/2010 | Yoshimi | G07F 17/34 273/143 R |
| 8,187,079 | B2 * | 5/2012 | Gomez | G07F 17/3227 463/20 |
| 8,360,846 | B1 * | 1/2013 | Bennett | G07F 17/32 463/20 |
| 2003/0022712 | A1 * | 1/2003 | Locke | G07F 17/3211 463/20 |
| 2004/0048646 | A1 * | 3/2004 | Visocnik | G07F 17/32 463/16 |
| 2008/0287178 | A1 * | 11/2008 | Berman | G07F 17/3211 463/20 |
| 2013/0143639 | A1 * | 6/2013 | Nakamura | G07F 17/32 463/20 |

* cited by examiner

*Primary Examiner* — Milap Shah

(57) ABSTRACT

Systems, apparatuses and methods for utilizing multi-mode symbols that interact with random game triggers to selectively activate gaming features. At least one multi-mode symbol is provided that includes at least first and second modes. When the multi-mode symbol is in the first mode, a first functionality is associated with the multi-mode symbol, such as its default symbol mode. In response to a trigger event involving the multi-mode symbol, the symbol is changed to exhibit the second mode, and a second symbol functionality is applied to the multi-mode symbol. Payouts are determined based on the first functionality of the multi-mode symbol when in the first mode, and based on the second functionality of the multi-mode symbol when in the second mode.

5 Claims, 8 Drawing Sheets

GAMING SYSTEMS AND METHODS UTILIZING MULTI-MODE GAME ELEMENTS

FIELD

This disclosure relates generally to games, and more particularly to gaming systems, apparatuses and methods utilizing game elements capable of state-changing interaction with feature triggers.

BACKGROUND

Casino games such as poker, slots, and craps have long been enjoyed as a means of entertainment. Some of these games originated using traditional elements such as playing cards or dice. More recently, gaming devices have been developed to simulate and/or further enhance these games while remaining entertaining. The popularity of casino gambling with wagering continues to increase, as does recreational gambling such as non-wagering computer game gambling. Part of this popularity is due to the increased development of new types of games that are implemented, at least in part, on gaming devices.

One reason that casino games are widely developed for gaming devices is that a wide variety of games can be implemented on gaming devices, thereby providing an array of choices for players looking to gamble. For example, the graphics and sounds included in such games can be modified to reflect popular subjects, such as movies and television shows. Game play rules and types of games can also vary greatly providing many different styles of gambling. Additionally, gaming devices require minimal supervision to operate on a casino floor, or in other gambling environments. That is, as compared to traditional casino games that require a dealer, banker, stickman, pit managers, etc., gaming devices need much less employee attention to operate.

With the ability to provide new content, players have come to expect the availability of an ever wider selection of new games when visiting casinos and other gaming venues. Playing new games adds to the excitement of "gaming." As is well known in the art and as used herein, the term "gaming" and "gaming devices" generally involves some form of wagering, and that players make wagers of value, whether actual currency or something else of value, e.g., token or credit. Wagering-type games usually provide rewards based on random chance as opposed to skill, although some skill may be an element in some types of games. Since random chance is a significant component of these games, they are sometimes referred to as "games of chance."

The present disclosure describes systems, apparatuses and methods that facilitate new and interesting gaming experiences, and provide advantages over the prior art.

SUMMARY

The present disclosure is directed to systems, apparatuses, computer-readable media, and/or methods that are configured to implement associations of multi-mode gaming symbols and game triggers to selectively activate gaming features in response to interactions between the multi-mode gaming symbols and the game triggers.

In accordance with one embodiment, a slot game apparatus is provided for enhancing gaming payouts in a slot game involving a succession of slot game events. The slot game apparatus includes a display, a user interface, a wager input device, and a processor. The display presents symbol locations that form a symbol array. The user interface includes at least one user input to enable a player to initiate a slot game event presented via the symbol array. The wager input device is structured to identify and validate player assets, and to permit the player to play the slot game event when the player assets are provided. The processor is configured with software to create operational modules to provide a multi-mode symbol(s) having at least first and second modes in connection with a slot game event, and to associate a first functionality with the multi-mode symbol when the multi-mode symbol is in the first mode. In response to a trigger event involving the multi-mode symbol, the processor changes the symbol to operate in the second mode, and applies a second symbol functionality to the multi-mode symbol. The processor determines payouts for the slot game event based on the first functionality of the multi-mode symbol when in the first mode, and based on the second functionality of the multi-mode symbol when in the second mode.

In a more particular embodiment of such a slot game apparatus, the processor is configured to provide multiple multi-mode symbols, each having the first mode that is associated with its respective first functionality, and is further configured to change the respective multi-mode symbol to the second state and apply the second symbol functionality in response to the occurrence of the trigger event. In a more particular embodiment, the second functionality is different for at least some of the plurality of the multi-mode symbols. In another embodiment, the processor is further configured to randomly initiate the trigger event at at least one of the symbol locations.

One embodiment involves the processor randomly initiating the trigger event using an overlay symbol at the at least one of the symbol locations to initiate the second symbol functionality. In a more particular embodiment, the processor is configured to direct the display to present the overlay symbol as an item that advances a perceived delivery from the overlay symbol to the multi-mode symbol to which it shares the at least one symbol location. Another embodiment involves the overlay symbol visually portraying an item having an interactive relationship with the multi-mode symbol to which it shares the symbol location, where the processor is configured to direct the display to present the item of the overlay symbol as interactively delivering to the multi-mode symbol serving as a consumer of the interactive relationship. In a more particular embodiment, the processor is configured to direct the display to depict a result of the overlay symbol interactively delivering to the multi-mode symbol serving as a consumer of the interactive relationship, and to create a payout enhancement in response thereto. Another particular embodiment involves the processor determining the payouts based on the second functionality of the multi-mode symbol by applying the payout enhancement to a slot game payout resulting from the slot game event that involves the symbol location to which the overlay symbol was presented.

In another embodiment of such a slot game apparatus, the processor is configured to determine a payout enhancement resulting from the interaction of the trigger event and the multi-mode symbol, to determine a slot game event payout involving the symbol location of the trigger event, and to determine the payouts based on the second functionality of the multi-mode symbol by applying the payout enhancement to the slot game event payout. In a more particular embodiment, the payout enhancement is any one or more of a multiplier (or other mathematical function, such as an exponent, etc.), a credit value, a symbol of higher value, a wild symbol, etc.

The first functionality of the multi-mode symbol comprises, in one embodiment, a default function of the multi-mode symbol based on its visual indicia. The second functionality of the multi-mode symbol comprises, in one embodiment, a payout enhancement to augment a slot game event payout involving the symbol location to which the trigger event is associated with.

In accordance with another embodiment, a slot game apparatus is provided for enhancing gaming payouts in a slot game involving a succession of slot game events. The slot game apparatus includes a display, a user interface, a wager input device, and a processor. The display presents symbol locations that form a symbol array. The user interface includes at least one user input to enable a player to initiate a slot game event presented via the symbol array. The wager input device is structured to identify and validate player assets, and to permit the player to play the slot game event when the player assets are provided. The processor is configured with software to create operational modules to provide a multi-mode symbol(s) having at least passive and active modes in connection with a slot game event, associate a default symbol functionality with the multi-mode symbol when the multi-mode symbol is in the passive mode, and randomly present a triggering symbol(s) with a first symbol location on the symbol array. The processor is further configured to establish a connecting path(s) between the symbol location associated with the triggering symbol and a second symbol location that is populated with the multi-mode symbol. The processor changes the multi-mode symbol to operate in the active mode in response to the triggering symbol being presented and the connecting path being established, and associates an updated symbol functionality with the multi-mode symbol in response thereto. The processor identifies a payout enhancement award based on the updated symbol functionality, and applies the payout enhancement to a slot game event payout involving the second symbol location.

In a more particular embodiment of such a slot game apparatus, the processor is configured to establish the connecting path(s) by establishing a network of paths between a plurality of the symbol locations of the symbol array, including the second symbol location.

In another embodiment, the processor is configured to establish the connecting path(s) by expanding the connecting path(s) from a current symbol location to a new symbol location on each of the slot game events.

In yet another embodiment, the processor is configured to establish the connecting path(s) by expanding the connecting path(s) from a current symbol location to a new symbol location on each of the slot game events, and to maintain the multi-mode symbol(s) on the symbol array during multiple reel spins, until the multi-mode symbol is operated in the active mode or a termination event occurs.

In another embodiment of such a slot game apparatus, the processor is further configured to provide at least one linking symbol, where the processor establishes the connecting path(s) in response to being positioned at the same symbol location as the linking symbol is positioned.

In accordance with yet another embodiment, a method is provided for enhancing gaming payouts in a slot game involving a succession of slot game events. The method includes identifying at least one gaming symbol as a multi-mode symbol, randomly populating the symbol locations of a symbol grid with standard gaming symbols and the multi-mode symbol, randomly positioning a symbol overlay at the symbol location of the multi-mode symbol, changing a default function of the multi-mode symbol to a payout enhancement value in response to the symbol overlay being randomly positioned at the symbol location of the multi-mode symbol, calculating a grid payout amount for winning symbol combinations involving the symbol location of the multi-mode symbol, and calculating a total payout amount by applying the payout enhancement to the grid payout amount.

This summary serves as an abbreviated, selective introduction of a representative subset of various concepts and embodiments that are further described or taught to those skilled in the art in the Specification herein. This summary is not intended to refer to all embodiments, scopes, or breadths of claims otherwise supported by the Specification, nor to identify essential features of the claimed subject matter, nor to limit the scope of the claimed subject matter.

DETAILED DESCRIPTION

Figure 1:
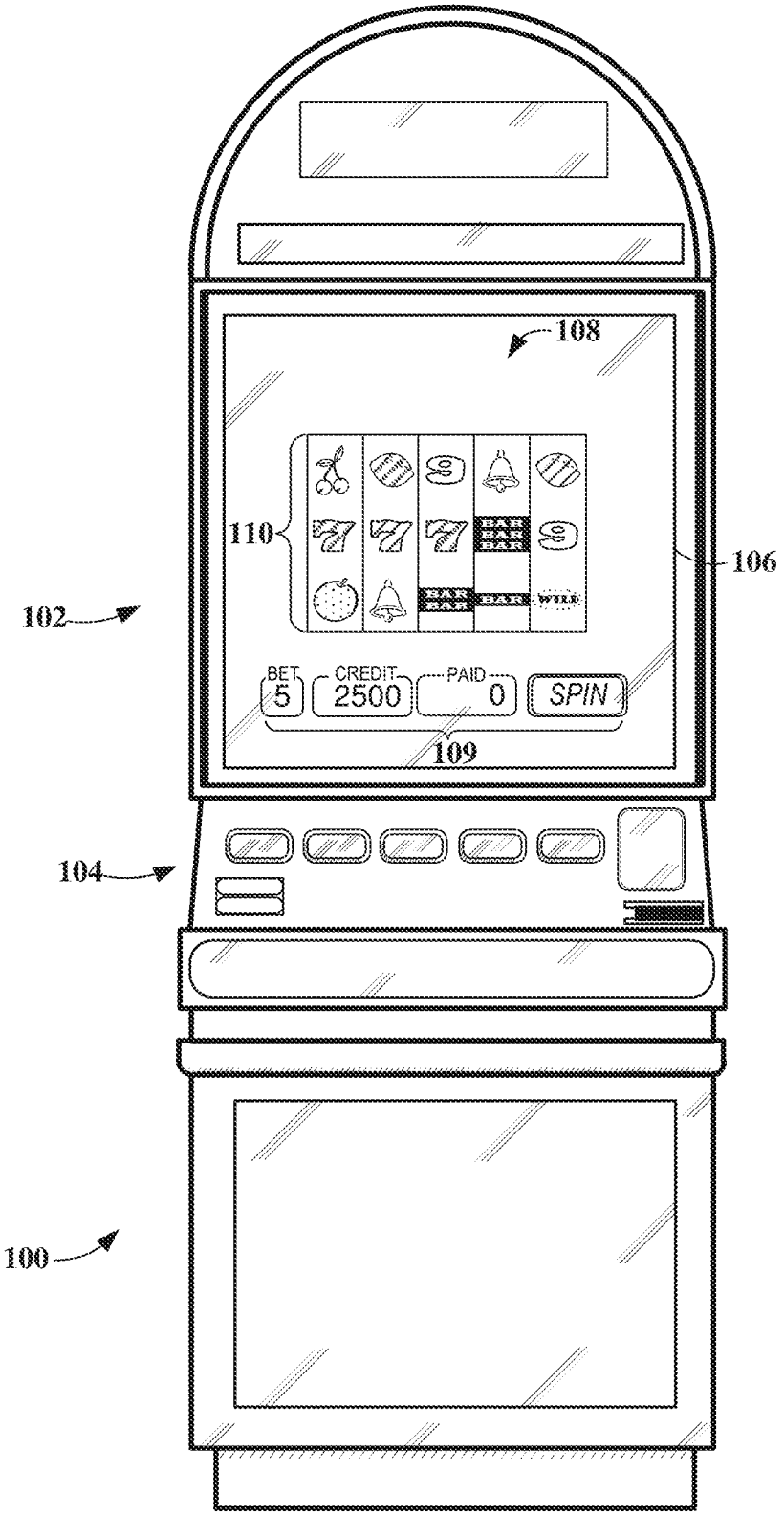
FIG. 1 is a diagram of a representative gaming machine capable of facilitating player use and interaction with games and features in accordance with the invention and representative embodiments described herein.

In the following description of various exemplary embodiments, reference is made to the accompanying drawings which form a part hereof, and in which is shown by way of illustration representative embodiments in which the features described herein may be practiced. It is to be understood that other embodiments may be utilized, as structural and operational changes may be made without departing from the scope of the disclosure.

In the description that follows, the terms "reels," "cards," "decks," and similar mechanically descriptive language may be used to describe various apparatus presentation features, as well as various actions occurring to those objects (e.g., "spin," "draw," "hold," "bet"). Although the present disclosure may be applicable to manual, mechanical, and/or computerized embodiments, as well as any combination therebetween, the use of mechanically descriptive terms is not meant to be only applicable to mechanical embodiments.

Those skilled in the art will understand that, for purposes of providing gaming experiences to players, mechanical elements such as cards, reels, and the like may be simulated on a display in order to provide a familiar and satisfying experience that emulates the behavior of mechanical objects, as well as emulating actions that occur in the non-computerized games (e.g., spinning, holding, drawing, betting). Further, the computerized version may provide the look of mechanical equivalents but may be generally randomized in a different way. Thus, the terms "cards," "decks," "reels," "hands," etc., are intended to describe both physical objects and emulation or simulations of those objects and their behaviors using electronic apparatuses.

In various embodiments, the gaming displays are described in conjunction with the use of data in the form of "symbols." In the context of this disclosure, a "symbol" may generally refer at least to a collection of one or more arbitrary indicia or signs that have some conventional or defined significance. In particular, the symbol may represent values that can at least be used to determine whether to award a payout. A symbol may include numbers, letters, shapes, pictures, textures, colors, sounds, etc., and any combination therebetween. A play state, such as a win, can be determined by comparing the symbol with one or more other symbols. Such comparisons can be performed, for example, via software by mapping numbers (or other data structures such as character strings) to the symbols and performing the comparisons on the numbers/data structures. Other conventions associated with known games (e.g., the numerical value/ordering of face cards and aces in card games) may also be programmatically analyzed to determine winning combinations.

Generally, systems, apparatuses and methods are described for utilizing game elements capable of state-changing interaction with feature triggers. The systems, apparatuses and methods described herein may be implemented as a single game, or part of a multi-part game. For example, the game features described herein may be implemented in primary gaming activities, bonus games, side bet games or other secondary games associated with a primary gaming activity. The game features may be implemented in stand-alone games, multi-player games, etc. Further, the disclosure may be applied to games of chance, and descriptions provided in the context of any representative game (e.g. slot game) is provided for purposes of facilitating an understanding of the features described herein. However, the principles described herein are equally applicable to any game of chance where an outcome(s) is determined for use in the player's gaming activity.

Embodiments of the present concept include providing gaming devices (also referred to as gaming apparatuses or gaming machines), gaming systems, and methods of operating these devices or systems to provide game play that involves implementing multistate game elements in gaming devices. In one embodiment, multi-mode symbol interact with random game triggers to selectively activate gaming features. At least one multi-mode symbol having at least first and second modes is provided. When the multi-mode symbol is in the first mode, a first functionality is associated with the multi-mode symbol, such as its default symbol mode. In response to a trigger event involving the multi-mode symbol, the symbol is changed to exhibit the second mode, and a second symbol functionality is applied to the multi-mode symbol. Payouts are determined based on the first functionality of the multi-mode symbol when in the first mode, and based on the second functionality of the multi-mode symbol when in the second mode. Other representative embodiments include, for example, a method of operating a gaming device that includes a game display with a game grid of game elements showing portions of a plurality of game reels, each having multiple game symbols, where the overlays are further used over the game grid to interact with the symbols appearing on the game grid as the result of gaming events.

Numerous variations are possible in view of these and other embodiments of the inventive concept. Representative embodiments and variations are described herein, with some embodiments described with reference to the drawings. However, many other embodiments and variations exist that are covered by the principles and scope of this concept. For example, although some of the embodiments discussed below involve reel-based slot machine examples of this concept, other embodiments include application of these inventive techniques in other types of slot games, poker games, roulette, bingo, or other games of chance. Some of these other types of embodiments will be discussed below as variations to the examples illustrated. However, many other types of games can implement similar techniques and fall within the scope of this disclosed concept.

Referring to the example gaming apparatus 100 shown in FIG. 1, the representative gaming apparatus includes at least a display area(s) 102 (also referred to as a gaming display), and a player interface area(s) 104, although some or all of the interactive mechanisms included in the user interface area 104 may be provided via other or additional means, such as graphical icons used with a touch screen in the display area 102 in some embodiments. The display area 102 may include one or more game displays 106 (also referred to as "displays" or "gaming displays") that may be included in physically separate displays or as portions of a common large display. Here, the representative game display 106 includes at least a primary game play portion 108 that displays game elements and symbols 110, and an operations portion 109 that can include meters, various game buttons and other input mechanisms, and/or other game information for a player of the gaming device 100.

The user interface 104 allows the user to control, engage in play of, and otherwise interact with the gaming machine 100. The particular user interface mechanisms included with user interface 104 may be dependent on the type of gaming device. For example, the user interface 104 may include one or more buttons, switches, joysticks, levers, pull-down handles, trackballs, voice-activated input, touchscreen input, tactile input, and/or any other user input system or mechanism that allows the user to play and interact with the particular gaming activity.

The user interface 104 may allow the user or player to enter coins, bills, or otherwise obtain credits through vouchers, tokens, credit cards, tickets, electronic money, etc. Various mechanisms for entering such vouchers, tokens, credit cards, coins, tickets, etc. are described below with reference to FIG. 2. For example, currency input mechanisms, card readers, credit card readers, smart card readers, punch card readers, radio frequency identifier (RFID) readers, and other mechanisms may be used to enter wagers. The user interface 104 may also include a mechanism to read and/or validate player information, such as player loyalty information to identify a user or player of the gaming device. This mechanism may be, for example, a card reader, biometric scanner, keypad, or other input device. It is through a user interface such as the user interface 104 that the player can initiate and engage in gaming activities. While the illustrated embodiment depicts various buttons for the user interface 104, it should be recognized that a wide variety of user interface options are available for use in connection with the present invention, including pressing buttons, touching a segment of a touch-screen, entering text, entering voice commands, or other known data entry methodology.

The game display 106 in the display area 102 may include one or more of an electronic display, a video display, a mechanical display, and fixed display information, such as pay table information associated with a glass/plastic panel(s) on the gaming machine 100 and/or graphical images. The symbols or other indicia associated with the play of the game may be presented on an electronic display device or on mechanical devices associated with a mechanical display. Generally, in some embodiments, the display 106 devotes the largest portion of viewable area to the primary gaming portion 108. The primary gaming portion 108 may provide visual feedback to the user for any selected game. The primary gaming portion 108 may render graphical objects such as cards, slot reels, dice, animated characters, and any other gaming visual known in the art. The primary gaming portion 108 may also inform players of the outcome of any particular event, including whether the event resulted in a win or loss.

In some example embodiments illustrated herein, the primary gaming portion 108 may display a grid (or equivalent arrangement) of game elements 110 or game element positions (also referred to herein as "reel stop positions"). As illustrated in the embodiment shown in FIG. 1, the grid includes three rows and five columns of game elements 110, which may form a game outcome(s) of a game play event from which prizes are determined. In some slot machine examples, each column may display a portion of a game reel. The game reels may include a combination of game symbols in a predefined order. In mechanical examples, the game reels may include physical reel strips where game symbols are shown in images fixed on the reel strips. Virtual reel strips may be mapped to these physical reel positions shown on the reel strips to expand the range or diversity of game outcomes. In video slot examples, reel strips may be encoded in a memory or database and virtual reels may be used for the game reels with images representing the data related to the reel strips. In other slot machine embodiments, each reel stop position on the grid may be associated with an independent reel strip. In yet other slot machine embodiments, reels and/or reel strips may not be used at all in determining the symbols shown in the game element positions of the grid. For example, a symbol may be randomly selected for each game element position, or the symbols may be determined in part by game events occurring during game play, such as displayed elements being replaced by new game elements or symbols. Numerous variations are possible for implementing slot-type game play.

The primary gaming portion 108 may include other features known in the art that facilitate gaming, such as status and control portion 109. As is generally known in the art, this portion 109 provides information about current bets, current wins, remaining credits, etc. associated with gaming activities of the grid of game elements 110. The control portion 109 may also provide touchscreen controls for facilitating game play. The grid of game elements 110 may also include touchscreen features, such as facilitating selection of individual symbols, or user controls over stopping or spinning reels. The game display 106 of the display area 102 may include other features that are not shown, such as pay tables, navigation controls, etc.

Figure 2:
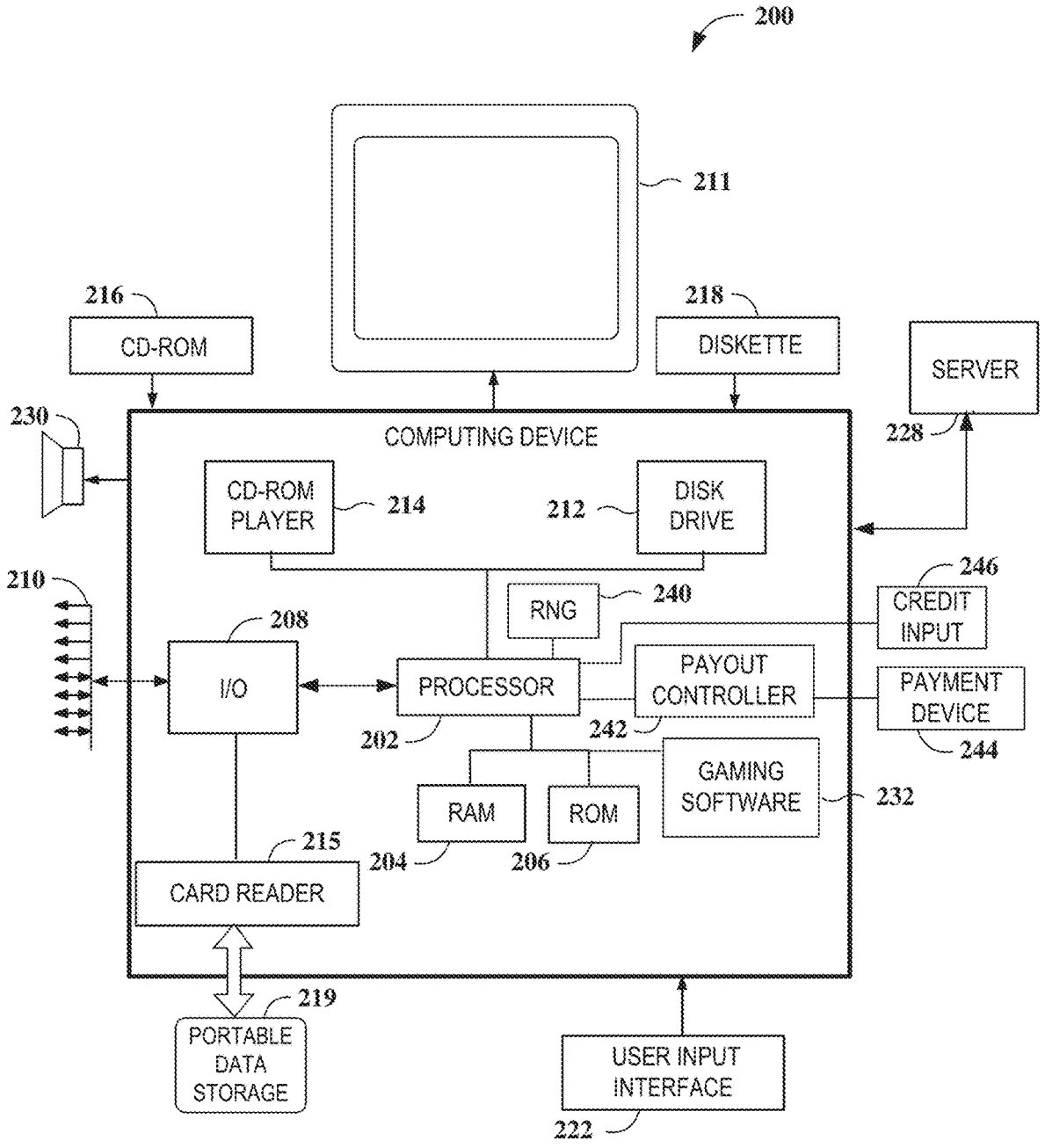
FIG. 2 is a block diagram illustrating a representative computing arrangement capable of implementing games and features in accordance with the invention and representative embodiments described herein.

Although FIG. 1 illustrates a particular implementation of some of the embodiments of this invention in a casino or electronic gaming machine ("EGM"), one or more devices may be programmed to play various embodiments of the invention. The concepts and embodiments described herein may be implemented, as shown in FIG. 1, as a casino gaming machine or other special purpose gaming kiosk as described herein, or may be implemented via computing systems operating under the direction of local gaming software, and/or remotely-provided software such as provided by an application service provider (ASP). Casino gaming machines may also utilize computing systems to control and manage the gaming activity, although these computing systems typically include specialized components and/or functionality to operate the particular elements of casino gaming machines. Additionally, computing systems operating over networks, such as the Internet, may also include specialized components and/or functionality to operate elements particular to these systems, such as random number generators. An example of a representative computing system capable of carrying out operations in accordance with the principles described herein is illustrated in FIG. 2.

Hardware, firmware, software or any combination thereof may be used to perform the various gaming functions, display presentations and operations described herein. The functional modules used in connection with the disclosure may reside in a gaming machine as described, or may alternatively reside on a stand-alone or networked computer. The representative computing structure 200 of FIG. 2 is an example of a computing structure that can be used in connection with such electronic gaming machines, computers, or other computer-implemented devices to carry out operations of the present invention. Although numerous components or elements are shown as part of this computing structure 200 in FIG. 2, additional or fewer components may be utilized in particular implementations of embodiments of the invention.

The example computing arrangement 200 suitable for performing the gaming functions described herein includes a processor, such as depicted by the representative central processing unit (CPU) 202, coupled to memory, such as random access memory (RAM) 204, and some variation of read-only memory (ROM) 206 or other persistent storage. The ROM 206 may also represent other types of storage media to store programs, such as programmable ROM (PROM), erasable PROM (EPROM or any technology capable of storing data). The processor 202 may communicate with other internal and external components through input/output (I/O) circuitry 208 and bussing 210, to communicate control signals, communication signals, and the like.

The computing arrangement 200 may also include one or more data storage devices, including hard and floppy disk drives 212, CD-ROM drives 214, card reader 215, and other hardware capable of reading and/or storing information such as DVD, etc. In one embodiment, software for carrying out the operations in accordance with the present invention may be stored and distributed on a CD-ROM 216, diskette 218, access card 219, or other form of computer readable media capable of portably storing information. These storage media may be inserted into, and read by, devices such as the CD-ROM drive 214, the disk drive 212, card reader 215, etc. The software may also be transmitted to the computing arrangement 200 via data signals, such as being downloaded electronically via a network, such as local area network (casino, property, or bank network) or a wide area network (e.g., the Internet). Further, as previously described, the software for carrying out the functions associated with the present invention may alternatively be stored in internal memory/storage of the computing device 200, such as in the ROM 206.

The computing arrangement 200 is coupled to one or more displays 211, which represent a manner in which the gaming activities may be presented. The display 211 represents the "presentation" of the game information in accordance with the disclosure, and may be a mechanical display showing physical spinning reels, a video display, such as liquid crystal displays, plasma displays, cathode ray tubes (CRT), digital light processing (DLP) displays, liquid crystal on silicon (LCOS) displays, etc., or any type of known display or presentation screen.

Where the computing device 200 represents a stand-alone or networked computer, the display 211 may represent a standard computer terminal or display capable of displaying multiple windows, frames, etc. Where the computing device 200 represents a mobile electronic device, the display 211 may represent the video display of the mobile electronic device. Where the computing device 200 is embedded within an electronic gaming machine, the display 211 corresponds to the display screen of the gaming machine/kiosk.

A user input interface 222 such as a mouse, keyboard/keypad, microphone, touch pad, trackball, joystick, touch screen, voice-recognition system, card reader, biometric scanner, RFID detector, etc. may be provided. The user input interface 222 may be used to input commands in the computing arrangement 200, such as placing wagers or initiating gaming events on the computing arrangement 200, inputting currency or other payment information to establish a credit amount or wager amount, inputting data to identify a player for a player loyalty system, etc. The display 211 may also act as a user input device, e.g., where the display 211 is a touchscreen device. In embodiments, where the computing device 200 is implemented in a personal computer, tablet, smart phone, or other consumer electronic device, the user interface and display may be the available input/output mechanisms related to those devices.

Chance-based gaming systems such as slot machines, in which the present invention is applicable, are governed by random numbers and processors, as facilitated by a random number generator (RNG) or other random generator. The fixed and dynamic symbols generated as part of a gaming activity may be produced using one or more RNGs. RNGs may be implemented using hardware, software operable in connection with the processor 202, or some combination of hardware and software. The principles described herein are operable using any known RNG, and may be integrally programmed as part of the processor 202 operation, or alternatively may be a separate RNG controller 240 that may be associated with the computing arrangement 200 or otherwise accessible such as via a network. The RNGs are often protected by one or more security measures to prevent tampering, such as by using secured circuitry, locks on the physical game cabinet, and/or remote circuitry that transmits data to the gaming device.

The computing arrangement 200 may be connected to other computing devices or gaming machines, such as via a network. The computing arrangement 200 may be connected to a network server(s) 228 in an intranet or local network configuration. The computer may further be part of a larger network configuration as in a global area network (GAN) such as the Internet. In such a case, the computer may have access to one or more web servers via the Internet. In other arrangements, the computing arrangement 200 may be configured as an Internet server and software for carrying out the operations in accordance with the present invention may interact with the player via one or more networks. The computing arrangement 200 may also be operable over a social network or other network environment that may or may not regulate the wagering and/or gaming activity associated with gaming events played on the computing arrangement.

Other components directed to gaming machine implementations include manners of gaming participant payment, and gaming machine payout. For example, a gaming machine including the computing arrangement 200 may also include a payout controller 242 to receive a signal from the processor 202 or other processor(s) indicating a payout is to made to a player and controlling a payout device 244 to facilitate payment of the payout to the player. In some embodiments, the payout controller 242 may independently determine the amount of payout to be provided to the participant or player. In other embodiments, the payout controller 242 may be integrally implemented with the processor 202. The payout controller 242 may be a hopper controller, a print driver, credit-transmitting device, bill-dispensing controller, accounting software, or other controller device configured to verify and/or facilitate payment to a player.

A payout or payment device 244 may also be provided in gaming machine embodiments, where the payment device 244 serves as the mechanism providing the payout to the player or participant. In some embodiments, the payment device 244 may be a hopper, where the hopper serves as the mechanism holding the coins/tokens of the machine, and/or distributing the coins/tokens to the player in response to a signal from the payout controller 242. In other embodiments, the payout device 244 may be a printer mechanism structured to print credit-based tickets that may be redeemed by the player for cash, credit, or other casino value-based currency or asset. In yet other embodiments, the payout device 244 may send a signal via the network server 228 or other device to electronically provide a credit amount to an account associated with the player, such as a credit card account or player loyalty account. The computing arrangement 200 may also include accounting data stored in one of the memory devices 204, 206. This accounting data may be transmitted to a casino accounting network or other network to manage accounting statistics for the computing arrangement or to provide verification data for the currency or currency-based tickets distributed by the payout device, such as providing the data associated with the bar codes printed on the currency-based tickets so they are identifiable as valid tickets for a particular amount when the player redeems them or inserts them in another gaming device.

The wager input module or device 246 represents any mechanism for accepting coins, tokens, coupons, bills, electronic fund transfer (EFT), tickets, credit cards, smart cards, membership/loyalty cards, or any other player assets, for which a participant inputs a wager amount. The wager input device 246 may include magnetic strip readers, bar code scanners, light sensors, or other detection devices to identify and validate physical currency, currency-based tickets, cards with magnetized-strips, or other medium inputted into the wager input device. When a particular medium is received in the wager input device 246, a signal may be generated to establish or increase an available credit amount or balance stored in the internal memory/storage of the computing device 200, such as in the RAM 204. Thereafter, specific wagers placed on games may reduce the available credit amount, while awards won may increase the available credit amount. It will be appreciated that the primary gaming software 232 may be able to control payouts via the payment device 244 and payout controller 242 for independently determined payout events.

Among other functions, the computing arrangement 200 provides an interactive experience to players via an input interface 222 and output devices, such as the display 211, speaker 230, etc. These experiences are generally controlled by gaming software 232 that controls a primary gaming activity of the computing arrangement 200. The gaming software 232 may be temporarily loaded into RAM 204, and may be stored locally using any combination of ROM 206, drives 212, media player 214, or other computer-readable storage media known in the art. The primary gaming software 232 may also be accessed remotely, such as via the server 228 or the Internet.

The primary gaming software 232 in the computing arrangement 200 may be an application software module. According to embodiments of the present invention, this software 232 provides a slot game or similar game of chance as described herein. For example, the software 232 may present, by way of the display 211, representations of symbols to map or otherwise display as part of a slot based game having reels. However, in other embodiments, the principles of this concept may be applied to poker games or other types of games of chance. One or more aligned positions of these game elements may be evaluated to determine awards based on a pay table. The software 232 may include instructions to provide other functionality as known in the art or as described and shown herein.

The systems, apparatuses and methods operable via these and analogous computing and gaming devices can support gaming features as described herein. Among other things, the present disclosure sets forth manners for allowing some indicator to interact with symbols populated onto a play grid or other area to interact with those symbols on the grid to enhance or otherwise change the play of the game and/or payouts available via the game, as a result of the interaction. In one embodiment, auxiliary symbols can interact with certain primary symbols that populate a play grid or otherwise provide constituent elements of a gaming activity.

For example, an association between the indicator(s) and one or more symbols of the gaming activity can be established, where these symbols subject to indicator associations may be referred to herein as "registered" symbols, or register reel symbols, or targeted symbols, etc. When the indicator(s) interacts with any of the registered symbols, additional game functionality and/or enhanced payouts are made available.

In one regard, this provides multiple states or modes for certain symbols, such as the "registered" symbols that have had some defined relationship or association with another symbol(s) serving as the indicator(s). These defined relationships may be determined in advance of participation in the gaming activity and thereby be formed as part of the game, or may be established dynamically during play of the game, based on some criterion/criteria being met. These multiple modes for registered symbols may include at least two modes or states, including a first mode where the registered symbol serves its normal purpose for the game, and a second mode where the registered symbol performs a different or additional function in response to activation of this second mode by an associated indicator. In one embodiment, other symbols that are not defined as multi-mode symbols will not be impacted nor change function when being presented with an indicator(s). Thus, in one embodiment, multi-mode symbols are provided, that are used in a first, normal or "passive" mode, and change to a second "active" mode in response to being triggered or otherwise activated by an established and associated indicator symbol or function.

Many representative embodiments disclosed herein are described in the context of a slot game, where symbols are matched on paylines or otherwise to determine payout awards. However, the principles described herein are equally applicable to other games of chance, as described herein and as will be readily apparent to those skilled in the art from the teachings herein. In one slot game embodiment, symbol "overlays" serve as indicators, and certain symbols (the "registered" symbols) on the reel strips of the primary slot game are defined to be associated, and activatable by, one, more or all of the indicators provided in that slot game. These registered symbols can therefore operate in multiple modes, where a different mode is invoked in response to the interaction (e.g., proximity interaction in one embodiment) with one or more of the overlay symbols. In such an embodiment, when the overlay symbol(s) is presented at a symbol location shared by one of the registered symbols, an active mode of the associated multi-mode symbol is invoked to provide some different functionality and/or ability to enhance the gaming activity payout. For example, the interaction may turn the underlying/associated symbol into a wild symbol serving as all or some subset of the reel symbols, and/or a payout modifier (e.g., multiplier), and/or credit award, and/or special feature symbol (e.g., bonus symbol, free spins, etc.), or the like.

Figure 3:
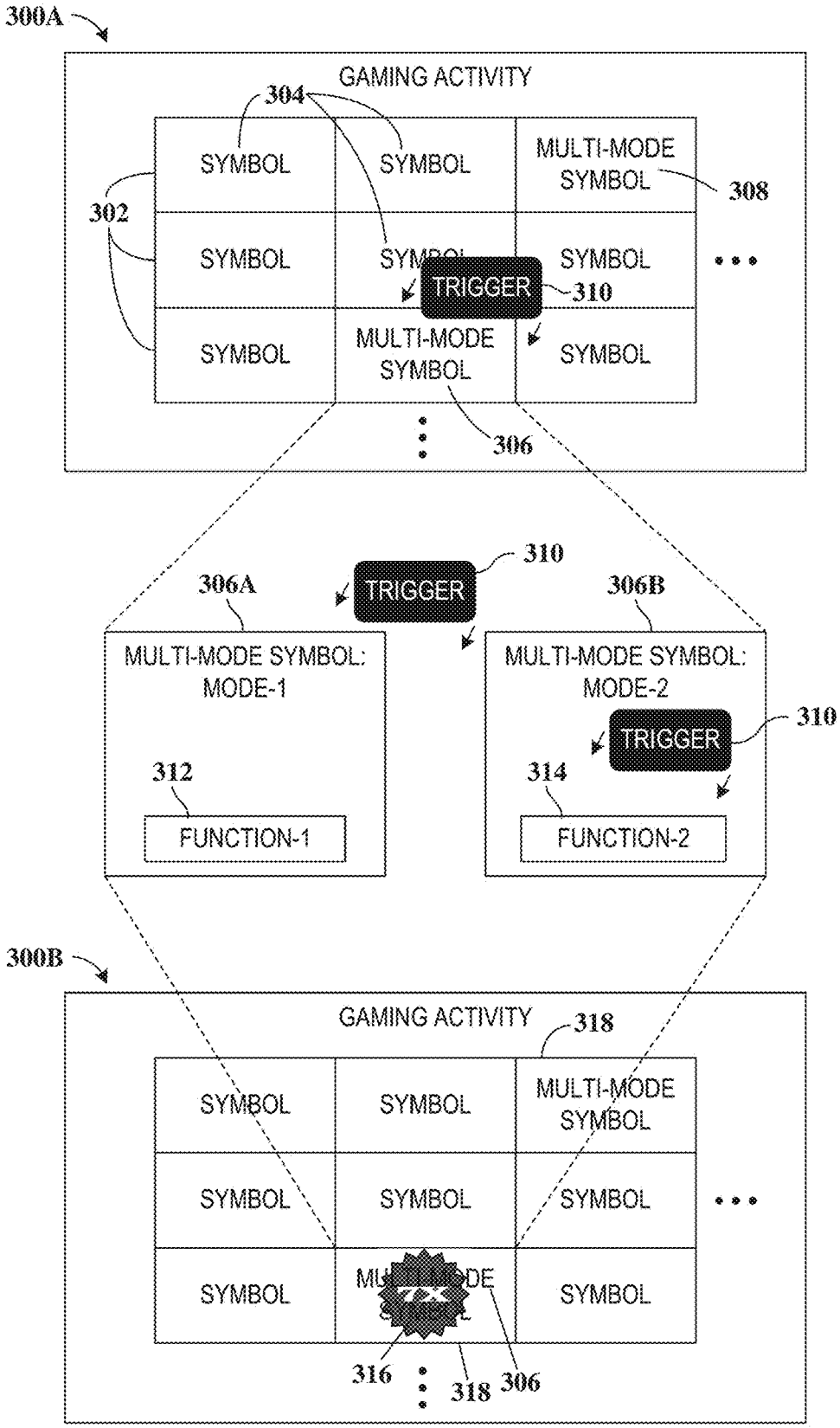
FIG. 3 is a block diagram illustrating a representative embodiment for utilizing multi-mode symbols that interact with random game triggers to selectively activate gaming features.

FIG. 3 is a block diagram illustrating a representative embodiment for utilizing multi-mode symbols that interact with random game triggers to selectively activate gaming features. Gaming activity 300A represents any desired game of chance, whether played for real money or simulated money. The gaming activity 300A may represent, for example, a slot game that includes a grid or other structure of symbol locations (e.g., representative symbol locations 302) in which game symbols (e.g., representative symbols 304) are presented, or a poker game where cards are the symbols in the game, or bingo, or any other such game that utilizes symbols.

In accordance with one embodiment, among the symbols 304 associated with the gaming activity 300A, is one or more multi-mode symbols 306, 308, also referred to herein collectively as registered reel symbols. These multi-mode symbols 306, 308 are registered in the sense that they are registered to have an affiliation with and/or response to a triggering symbol 310 or other triggering indicator (e.g., symbol overlay, sub-symbol, special symbol, symbol location highlighting, etc). In one embodiment, the trigger symbol 310 represents an overlay, which may appear in place of an existing symbol 304 or multi-mode symbol 306, 308, or may visually appear to float into a symbol location 302, or highlight a symbol location 302, etc. In one embodiment, if the trigger 310 appears with or otherwise interacts with any symbol 304, the symbol 304 does not change, nor does it functionality change. On the other hand, if the trigger symbol 310 appears with or otherwise interacts with a multi-mode symbol 306, 308, a defined action, function, payout, or other defined result may occur.

An example of a multi-mode symbol is now described. The multi-mode symbol 306A of FIG. 3 represents a first state of a symbol that was defined in advance, or dynamically defined during game play, to have at least two distinct functions. The multi-mode symbol 306 may be in a first multi-mode symbol mode 306A, when no trigger 310 has interacted with it during game play. The function-1 312 associated with mode-1 may be the symbol's 306A normal state, such as serving as a symbol to attempt to create symbol combinations defined in a paytable to provide a payout or return on the wager in a slot game. When a trigger 310 becomes associated with and thereby interacts with a multi-mode symbol 306, the multi-mode symbol 306 changes to an active mode, shown as multi-mode symbol mode-2 306B in the illustrated embodiment, that involves at least one different function, depicted as function-2 314. For example, the function-2 314 associated with mode-2 may be to change the multi-mode symbol 306A to a payout modifier, to an awarded credit value, to a bonus symbol or bonus event, to activate other features such as a free spin feature, etc. Had the trigger 310 interacted with a symbol 304 that was not a multi-mode symbol, no such second function 314 would occur in accordance with one embodiment.

FIG. 3 also shows a subsequent state of the gaming activity 300A, depicted as gaming activity 300B. This subsequent state depicts one representative example of a new function 314 that may be applied when the trigger 310 interacts with the multi-mode symbol 306. In this example, the interaction causes a multiplier 316 (or in other embodiments a multiplier-wild symbol) to occur at the respective symbol location 318. The multiplier functionality represents just one function that may result from the interaction of the trigger 310 and the original multi-mode symbol 306A.

In various embodiments, the trigger symbol 310, such as a symbol overlay, may overtake the existing symbol 306, may transform the existing symbol 306 to another symbol (e.g., wild symbol) and/or function (e.g., multiplier), can meld the existing symbol 306 with an overlay symbol or other trigger symbol 310 to create a new image, symbol, function, etc.

In one embodiment, the multi-mode symbols (e.g., 306, 308) may be designed such that the objects they depict have some sort of real life dynamic or interaction with the trigger 310. For example, the underlying multi-mode symbol 306 may depict something that would ordinarily or possibly interact with something depicted by the trigger symbol 310. As a more particular example, the multi-mode symbol 306 could represent a live plant, and the trigger 310 could represent a watering can, whereby interaction of the trigger 310 (watering can) sprinkles water on the multi-mode symbol 306 (live plant), thereby invoking a second function 314 as a result of the functional and visual interaction. In such an example, the multi-mode symbol 306 becomes active when triggers 310 become connected and "deliver" to these registered symbols. This connection may happen in one of several ways, such as an overlay or other trigger 310 appearing upon the symbol itself, or by the overlay symbol location 318 having a connecting path to one or more registered symbols. Examples of other coordinated functional and/or visual interactions are described in greater detail below.

Figure 4:
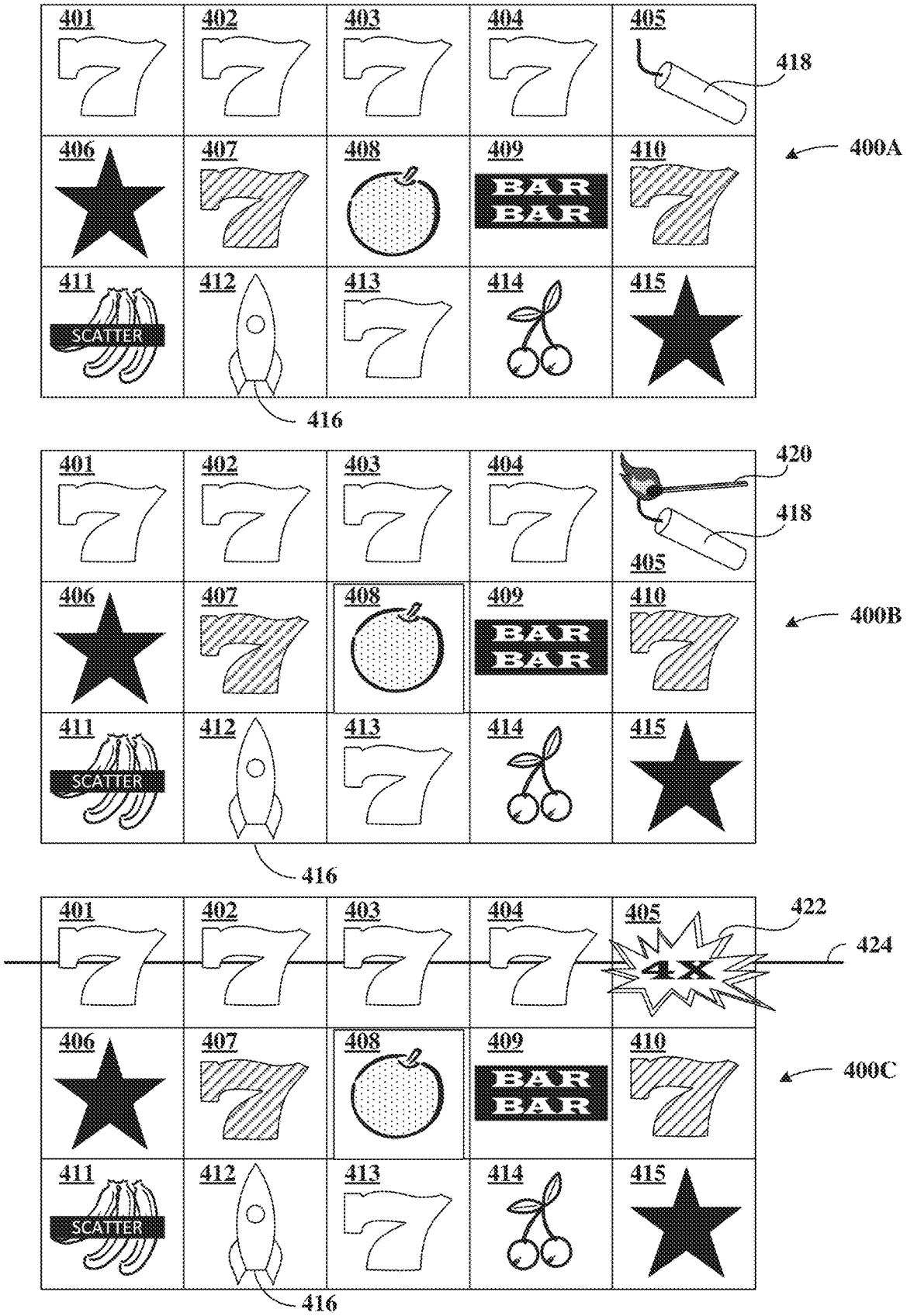
FIG. 4 depicts a slot game depicting the interaction of a trigger with a multi-mode symbol to invoke a function that the multi-mode symbol would not otherwise produce without the trigger and resulting interaction.

FIG. 4 depicts a slot game embodiment where a trigger symbol interacts with a multi-mode symbol to cause a function that the multi-mode symbol would not produce without the trigger and resulting interaction. This example follows a progression of three slot states, namely at initial grid 400A, intermediate grid 400B, and final grid 400C. Grid 400A includes a plurality of symbol locations 401-415, which in the illustrated embodiment is a 3×5 (3 row, 5 column) grid.

In this example, it is assumed that a particular subset of the reel symbols is designed such that the objects they depict would have some sort of real life dynamic relationship with the object(s) depicted by the overlay symbol(s). This registered symbol set includes multi-mode symbols, each having active and passive states. In one embodiment, the multi-mode symbols' 416, 418 natural state is passive, that is they behave just as traditional slot game reel symbols. A characteristic of the multi-mode feature is the addition of the concept of an active state. The multi-mode symbols become active when overlays (or other triggers) become connected and "deliver" to these registered multi-mode symbols. The connection may happen on an individual symbol or symbol location basis, or a connecting path(s) or network may provide a path(s) to a multi-mode symbol. For purposes of the example of FIG. 4, the connection described is on an individual symbol or symbol location basis.

In the example of FIG. 4, symbol locations 405 and 412 include multi-mode symbols 418, 416 respectively. Symbols that are multi-mode symbols may be known to the player of the game, such as by way of game information provided to the player. In an alternative embodiment, the player may not be notified of which symbols are multi-mode symbols, such as where the multi-mode symbols are dynamically selected, and their status as a multi-mode symbol is determined when an interaction with a trigger occurs. For purposes of the example of FIG. 4, it is assumed that players of the game are informed of which symbols are multi-mode (i.e. registered) symbols that can interact with triggers such as overlays.

A game including the features described herein may, if desired, be designed with a theme such that those overlays or other triggers, i.e. the "providers," have images or characteristics creating a logical association with the multi-mode symbols to which it can activate. In the embodiment of FIG. 4, the registered reel symbols include one or more "ignitable" objects, such as firecrackers, rockets, bombs, cannons, etc. Multi-mode symbol 418 depicts, for example, a firecracker with a fuse. In this embodiment, the trigger (i.e. provider) is implemented as a symbol overlay, which may move to or otherwise appear at one or more symbol locations. As depicted at grid 400B, a symbol overlay (e.g., trigger) appears, which in the illustrated embodiment is depicted as a flame source, such as a match symbol overlay 420. The match symbol overlay 420 positions itself proximate symbol location 405, where the firecracker symbol 418 is positioned. The match symbol overlay 420 interacts with the registered multi-mode firecracker symbol 418, causing another function to occur as a result of the interaction.

Grid 400C depicts a subsequent stage, after the interaction of the symbol overlay 420 and the multi-mode symbol 418. While the function resulting from the interaction may be any desired function, in the example of FIG. 4, the resulting function is a 4× (four times) multiplier 422, where the multi-mode symbol can also serve as its original symbol (a firecracker in this example). In such an embodiment, the player may receive a payout for a series of four "7" symbols in symbol locations 401, 402, 403, 404, and the 4× multiplier 422 to multiply the payout by four.

In another embodiment, the 4× multiplier 422 could have different or additional functionality, such as a multiplier-wild functionality, such as a 4×-wild where the wild functionality serves as any symbol (or a defined subject of the symbols) that also provides a 4× multiplier for any winning payouts on paylines involving that symbol. In such an embodiment, the player would receive a payout for a series of five "7" symbols, including "7" symbols on payline 424 including symbol locations 401, 402, 403, 404, and a 4×-wild symbol 422 at symbol location 405. Any payout for the five-symbol combination would then be multiplied by four, in this example.

As seen at slot grid 400C, multi-mode symbol 416 did not change functionality, but rather remained as its original symbol, which is a rocket symbol in this example. As no trigger 420 or other such "provider" interacted with multi-mode symbol 416 at symbol location 412, it remained in its default state.

Figure 5:
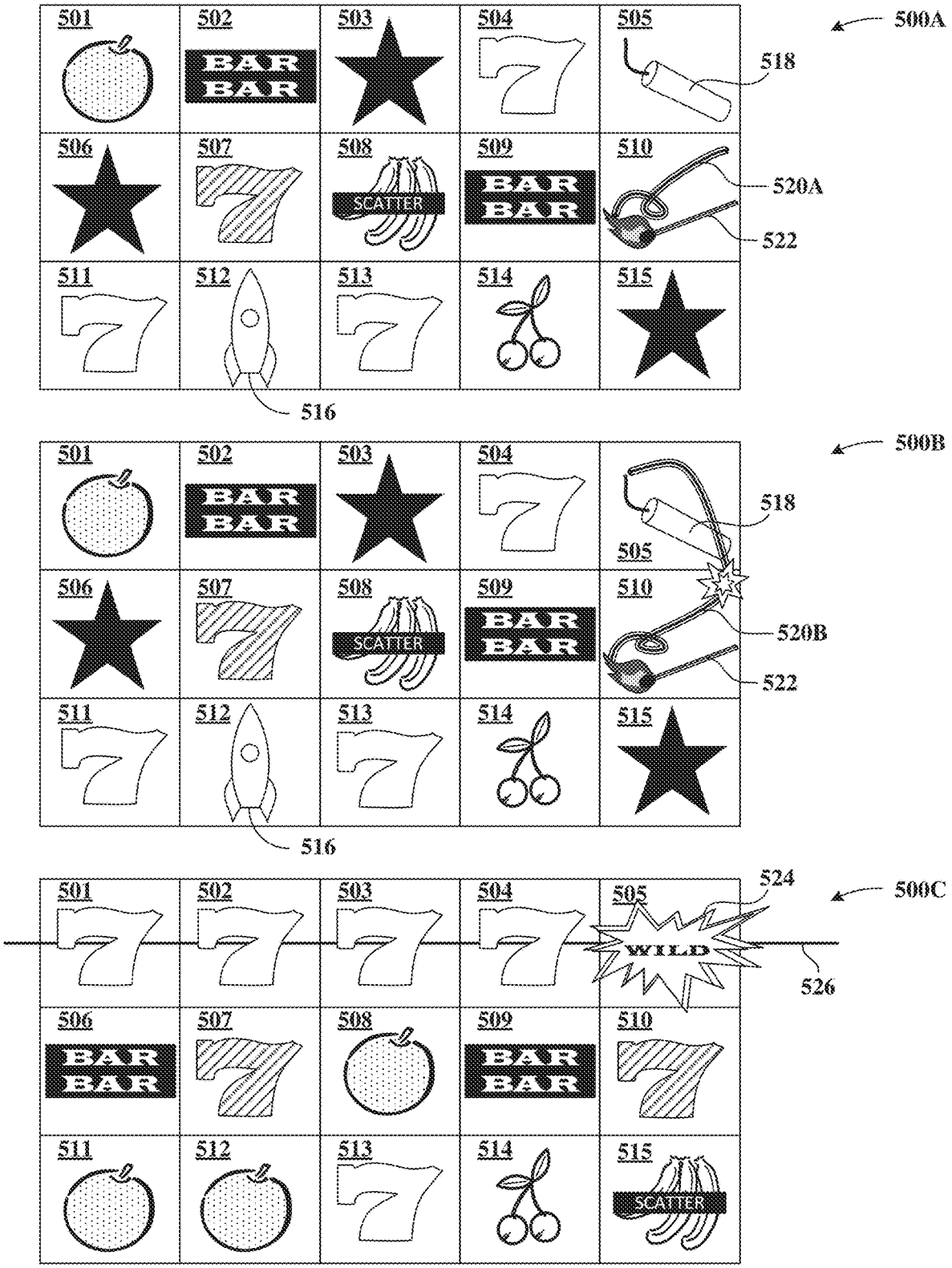
FIG. 5 depicts a slot game depicting an interaction of a trigger with a connector or network pathway to ultimately lead to one or more multi-mode symbols on the grid.

As noted above, the connections or interactions between triggers and registered symbols may happen in one of several ways, such as an overlay or other trigger appearing upon or with the symbol itself (e.g., example of FIG. 4), or by the trigger/provider symbol having a connecting path to one or more registered symbols. FIG. 5 depicts a slot game embodiment where a trigger symbol interacts with a connector or network pathway to ultimately lead to one or more multi-mode symbols on the grid. This example follows a progression of three slot states, namely at initial grid 500A, intermediate grid 500B, and final grid 500C. Grid 500A includes a plurality of symbol locations 501-515, which in the illustrated embodiment is a 3×5 (3 row, 5 column) grid. Two multi-mode symbols 516, 518 have been randomly positioned in symbol locations 512, 505 respectively.

In this example, it is again assumed that a particular subset of the reel symbols is designed such that the objects they depict would have some sort of real life dynamic relationship with the object(s) depicted by the overlay symbol(s). This registered symbol set includes multi-mode symbols, each having active and passive states. In one embodiment, the multi-mode symbols' 516, 518 natural state is passive, that is they behave just as traditional slot game reel symbols. The multi-mode symbols 516, 518 become active when overlays (or other triggers) become connected and deliver to these registered multi-mode symbols. In the illustrated embodiment of FIG. 5, no trigger symbol (e.g., overlay) has positioned itself proximate the multi-mode symbols 516, 518.

However, as previously noted, the connection or interaction between the overlay and a multi-mode symbol need not be direct, i.e. by a direct association, such as by occupying the same symbol location. In some embodiments, the interaction may occur via a connecting path(s) or network that provides one or more paths to a multi-mode symbol(s). For purposes of the example of FIG. 5, the connection described is by way of a connecting path from a symbol location where the trigger/provider has been presented to a symbol location where a multi-mode symbol resides.

Particularly, grid 500A included two multi-mode symbols 516, 518, but also provided a means for the overlay symbol 522 to reach one or more multi-mode symbols. Some mechanism determines when to create, add to, and clear connector or network paths that may be provided randomly, periodically, under certain circumstances (e.g., the overlay 522 did not land on a multi-mode symbol), etc. The rules that determine this may be any desired rules. In one embodiment, a linking function may be provided to connect providers (e.g., overlay symbols) to consumers (e.g., the multi-mode symbols). For example, a linking symbol 520A may be provided, that serves as a conduit between the overlay symbol 522 and one or more of the multi-mode symbols 516, 518.

In the illustrated embodiment, the linking symbol 520A is depicted in the form of a fuse, to maintain the theme of a provider (e.g., match or other flame overlay symbol 522), consumer (e.g., firecracker symbol 518, rocket symbol 516), and network (e.g., fuse symbol 520A). In one embodiment, the linking symbol 520A may be confined, at least initially, to a symbol location such as symbol location 510. The linking symbol 520A may be developed to accept what is provided by the overlay symbol 522 or other trigger, and to transfer it to one or more multi-mode symbol, which operate as consumers of what is provided by the overlay symbol 522.

In the example of FIG. 5, at grid 500B, this is depicted by an extension of the "fuse" symbol 520 across the boundaries of its symbol location 510 and into another symbol location 505, where a multi-mode symbol 518 resides. The connector or network can expand one symbol location at a time, such as expanding over time, or on each reel spin, or based on adjacent symbols, or based on theme (e.g., a linking function with a water conduit may flow downward on the grid), etc. The linking symbol may migrate randomly, may migrate towards one, more, or all multi-mode symbols on the grid, etc. The linking feature may continue until something stops it, such as a blocking symbol, not reaching a multi-mode symbol, lapse of time or number of reel spins, etc. In other embodiments, additional fuse symbols 520 (or other linking symbols or functions) may be randomly overlaid or positioned on the grid to essentially form a network to link the provider(s) with the consumer(s), i.e. to link the overlay symbols 522 with one or more multi-mode symbols 516, 518. If the additional link overlay symbols provide a continuous path (e.g., a continuous fuse in this example), then the overlay symbol 522 can still interact with one or more of the multi-mode symbols 516, 518 via the linking function provided. Therefore, such linking functionality extends the reach of the overlay symbol 522 providers to multi-mode symbols 516, 518 outside of its current location, in order to provide the gaming enhancements otherwise available when such providers and consumers interact.

As shown at the grid 500B, the linking fuse symbol 520B has been extended into the symbol location 505 to reach a multi-mode symbol 518, which is a firecracker symbol in this example. By way of this linking, the overlay symbol 522 thereby interacts with the multi-mode symbol 518, causing the multi-mode symbol 518 to provide a second functionality. The linking symbol 520B may be provided across the symbol location boundary before, during, or after the next reel spin. Upon the fuse burning to the multi-mode symbol 518, as shown at grid 500C, the interaction causes a new functionality, which in the present example is a wild symbol 524, which may or may not be provided with additional functionality such as payout modifiers, or the like.

While the function resulting from the interaction may be any desired function, in the example of FIG. 5, the resulting function is a wild symbol, causing a winning combination of five "7" symbols on payline 526 including symbol locations 501, 502, 503, 504, and 505. In other embodiments, a payout modifier such as a multiplier may additionally be associated with the wild symbol 524. For example, a 5× multiplier could also be associated with the wild symbol 524, thereby multiplying the payout to the combination of five "7" symbols on payline 526 by five.

The example of FIG. 5 illustrates a situation where the overlay or provider extends its reach to multi-mode symbols via a linking function. Thus, in the event the overlay symbol 522 did not land directly on a registered symbol, the "delivery" happens when whatever is provided by the provider traverses the network and actually reaches one or more of the multi-mode symbols. The traversal may occur incrementally with each subsequent spin by, for example, moving one symbol location per spin. Connected symbols could be fixed in place during this process, such as the multi-mode symbols 516, 518. Symbol activation could be accompanied by animations and enhanced awards, such as burning fuses, and explosions in the present example. It should be noted that the relationship between overlays and multi-mode symbols could alternatively be inverted, if desired, where the multi-mode symbols serve as the providers and the overlays serve as consumers.

Figure 6:
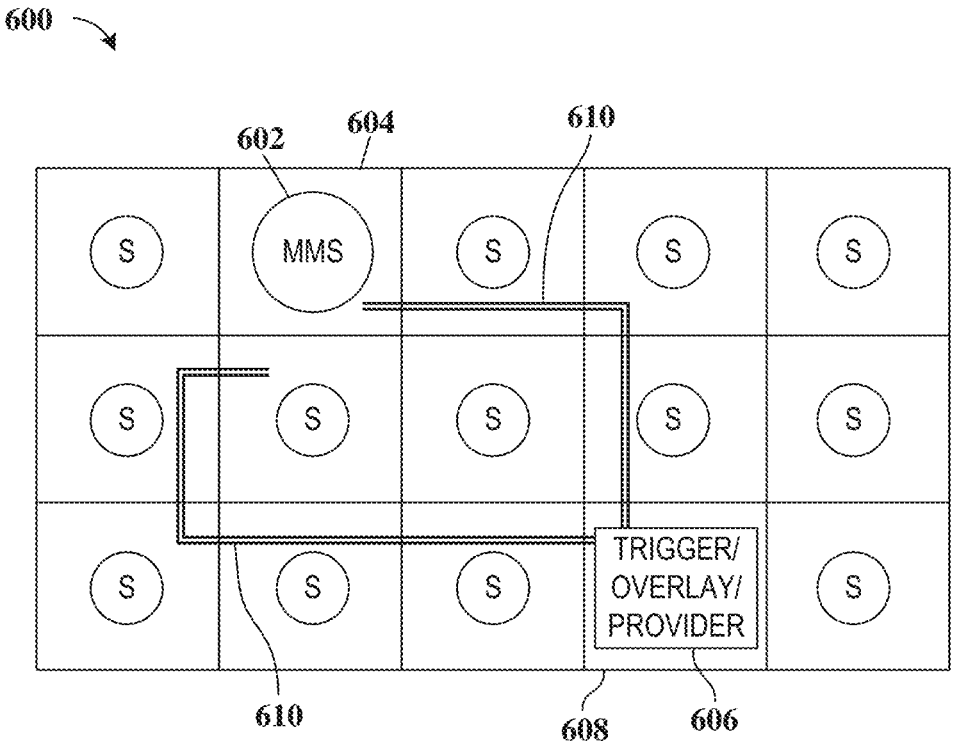
FIG. 6 depicts a representative slot game grid where connectors or a network facilitates interactions between otherwise non-interacting trigger symbols and multi-mode symbols.

In addition to networks or other linking functions being capable of migrating randomly about the grid 500B or intentionally towards or to multi-mode symbols, the linking function may be in the form of a more extensive linking network. In one embodiment, where an overlay symbol does not coexist with or otherwise get directly associated with a multi-mode symbol, a network that traverses multiple symbol locations may be provided, whether incrementally (e.g., over time, over reel spins, etc.) or all at once. FIG. 6 depicts a representative slot game grid 600 that is shown to be populated during a reel spin with a number of standard symbols "S," at least one multi-mode symbol (MMS) 602 at symbol location 604, and a trigger symbol 606, which serves as the "provider" in this example, and is assumed to be provided by way of an overlay symbol.

As seen in FIG. 6, the overlay symbol 606 did not land on a multi-mode symbol, although one exists at symbol location 604 in the grid 600. In one embodiment, a network 610 is randomly placed on the grid 600 that may immediately reach a multi-mode symbol 602, may reach it over time or some number of reel spins, may be positioned until a multi-mode symbol randomly occurs in connection with a reel spin at a location along the network 610, etc. Such a network may be persistent, in that it remains on the grid over the course of multiple reel spins, or may be transitory in that it remains for a single reel spin or for some other limited time or purpose. In other embodiments, the network 610 expands, contracts, changes direction, changes number of limbs, and/or changes in any other desired manner to ultimately route the network 610 within the grid 600.

The functionality provided herein may be implemented in games in a themed manner, whereby the providers, network, and consumers present in a way as to have some sort of real-life dynamic relationship. In one embodiment, a game theme may be at least in part based on fireworks or other explosives. In such a case, some of the reel symbols may be firecrackers, rockets, bombs, cannons, and/or other analogous items. The overlay symbol could then be selected to be a flame, and the network could be fuse lines, similar to that described in connection with FIG. 5. Upon completion of a reel spin, evaluation logic checks if a flame landed on an explosive, and if so sets it off. If the flame lands on a fuse instead, the fuse is lit. Connected explosives at the time of this ignition could be locked in place until they explode. The fuse then burns downstream to the next, adjacent symbol location with each spin that follows. In other embodiments, the fuse could burn downstream perhaps two locations if the fuse was lit somewhere other than an end of the fuse. Any explosives encountered along the path are ignited and activated, thereby providing payout enhancements and/or other gaming benefits. If desired, the burning of the fuse could stop at the first explosive. If no explosives are encountered along the fuse path, it may simply burn up and disappear. This represents one example of a themed game employing multi-mode symbol interaction features as described herein.

Another example of a themed game implementing the features described herein could be based on electronics. Circuits include power sources connected to various loads by way of wiring connections. In terms of a slot game, the battery(s) (e.g., provider) could be provided via symbol overlays, circuit wiring (e.g., network) could be presented as winding through symbol locations, and some reel symbols may be depicted as power-consuming electronics (consumers). Electrical symbols could energize with some vibrant art when eventually connected to the power supply, and thereby providing ways to enhance payouts in such games.

Another representative example involves a farming or plant-based theme that uses water as the provider (e.g., overlay or other trigger), an irrigation system as the network, and crops or flowers as the consumers. Symbols that are "watered" could then activate. Other, different triggers/overlay symbols could add other themed elements, such as a "sunlight" overlay that when occurring with a water overlay could produce even better results, or increase the odds of obtaining better results (and consequently better payout enhancers, higher credit awards, etc.). Yet another overlay could be added, such as a "fertilizer" overlay. In such an implementation, perhaps a regional network system would be preferred to lines running through symbol locations. Thus, symbol locations could be grouped into overlay regions that may overlap each other. In one embodiment, after a reel spin, some portion of the grid (e.g., the upper left area) may be more illuminated to indicate sunlight, rain cloud showers could hover over a middle area, and fertilizer dots could appear over a lower left region. In one embodiment, the presence of all overlays may be required for activation, or use the presence of multiple overlay types to enhance awards further.

The gaming features provided herein can be used in connection with any game of chance, including slot games, poker games, keno, roulette, bingo, and the like. They may be provided using physical structures, or electronic structures created in computing hardware and displayed as virtual structures of such physical structures. As previously noted, the gaming events described herein may be provided as a primary game of chance, a bonus game, etc.

Figure 7A:
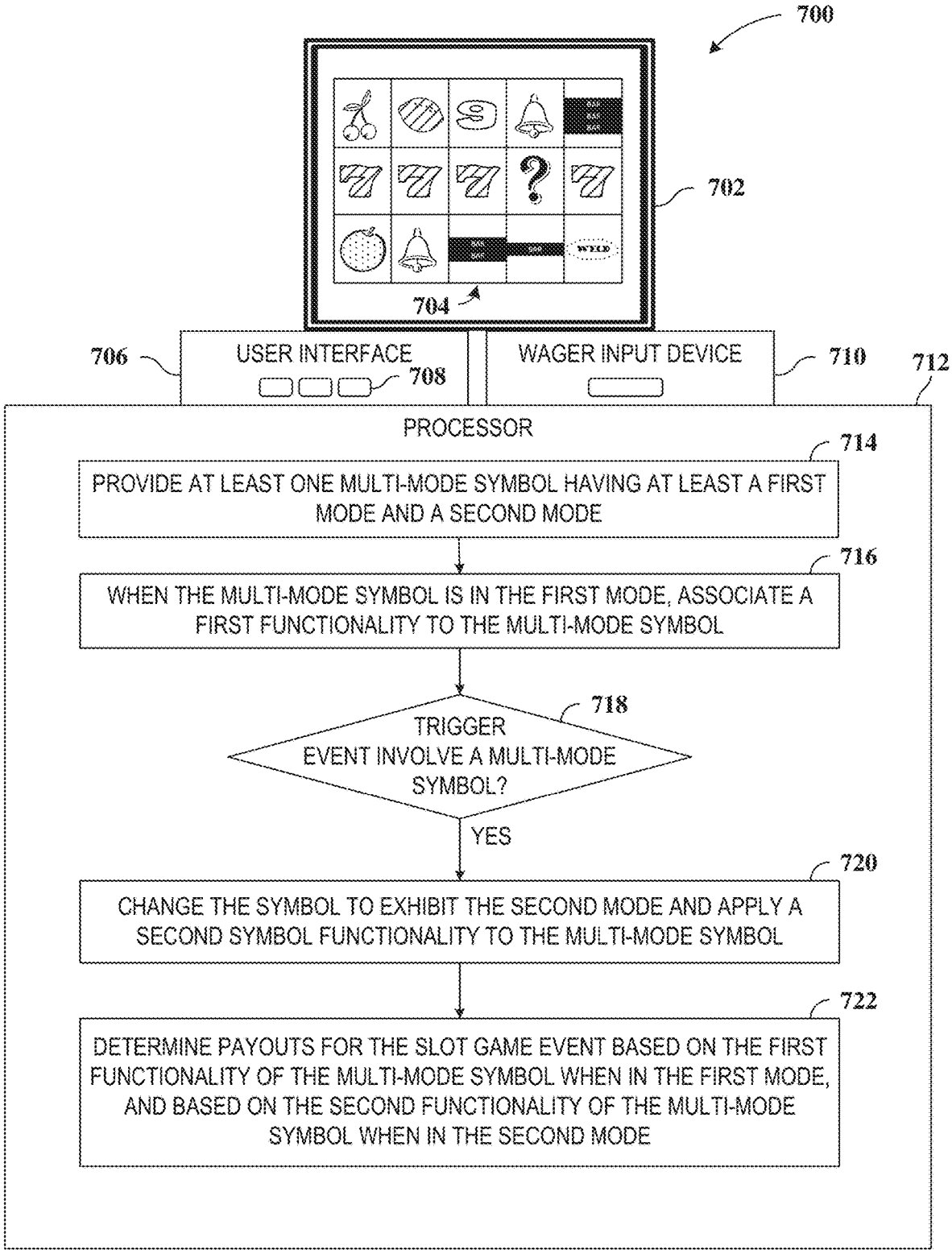
FIGS. 7A and 7B are block diagrams of representative slot game devices for enhancing gaming payouts using multi-mode symbol and interaction rules.

FIG. 7A is a block diagram of a representative slot game apparatus for enhancing gaming payouts in a slot game involving a succession of slot game events. In this embodiment, a slot game device 700 is provided on which players can play slot games. The representative slot game device 700 includes at least a display 702 presenting a slot game symbol array or "grid" 704 of symbol locations, a user interface 706 including at least one user input 708 to enable a player to initiate a slot game event presented via the slot game grid 704, and a wager input device 710 structured to identify and validate player assets and ultimately permit the player to play the slot game event when the player assets are provided. The slot game device 700 also includes a processor 712, which in the illustrated embodiment is configured to provide 714 at least one multi-mode symbol having at least a first mode and a second mode, and when the multi-state symbol is in the first mode, to associate 716 a first functionality to the multi-mode symbol. In response to a trigger condition involving the multi-mode symbol as determined at block 718, the processor is configured to change 720 the symbol to exhibit the second mode, and to apply a second symbol functionality to the multi-mode symbol. The processor determines 722 payouts for the slot game event based on the first functionality of the multi-mode symbol when in the first mode, and based on the second functionality of the multi-mode symbol when in the second mode.

The slot game device 700 configures the processor 712 (which may include one or more cooperative processing devices) to structurally program functional elements into hardware modules. Processor 712 circuitry configuration thus changes based on the modules developed by software to carry out the desired methodology. For example, the processor 712 is programmed by software/code to create a hardware-based module to provide 732 multi-mode symbols, and to create other such software/code modules for each of the operations 714-722.

Figure 7B:
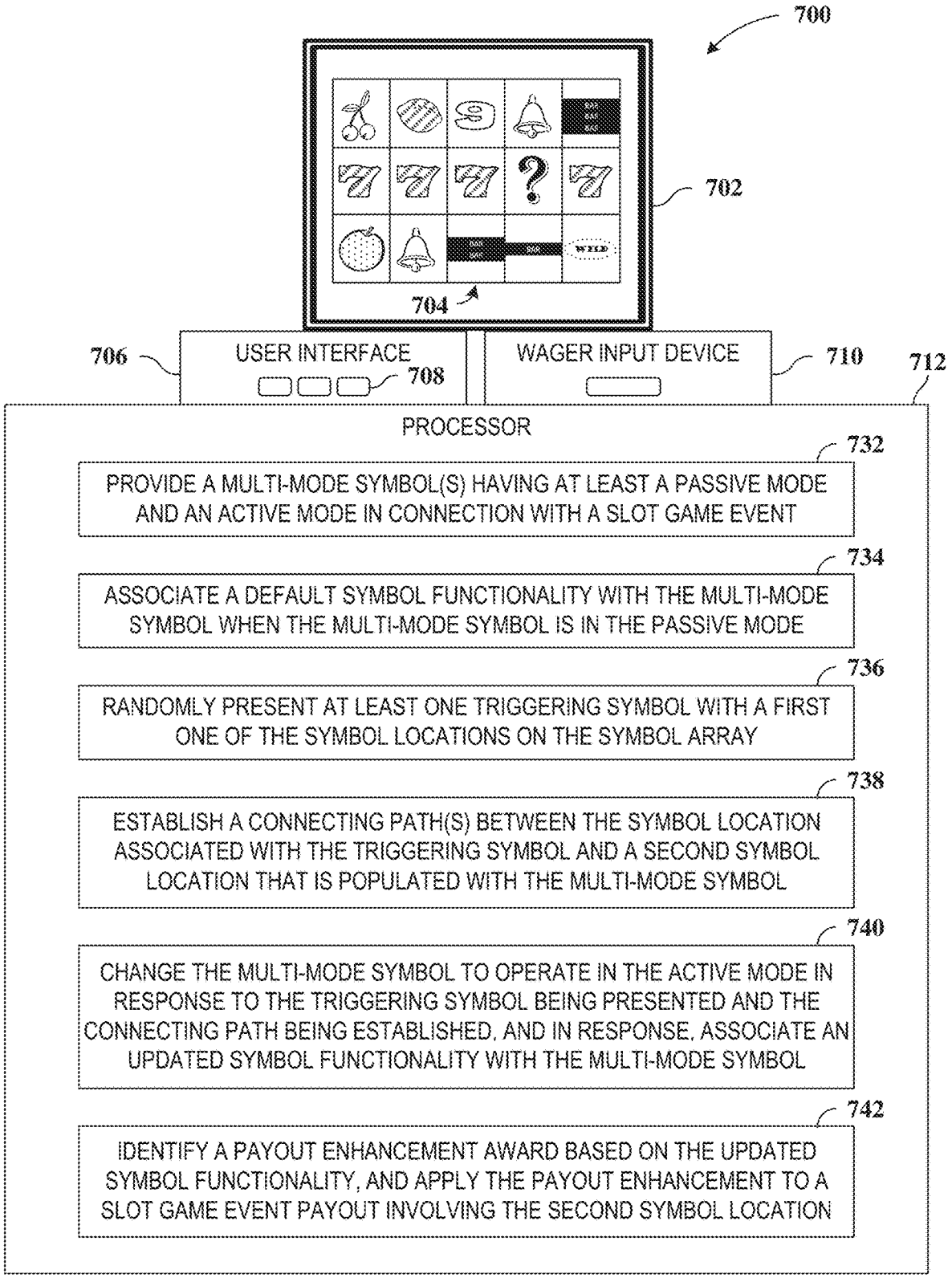

Other structural modules may be created on the slot game device using a properly configured processor 712. Referring now to the example of FIG. 7B, the processor 712 may be configured into programmed modules to provide 732, in connection with the slot game event, a multi-mode symbol(s) having at least a passive mode and an active mode, and associate 734 a default symbol functionality with the multi-mode symbol when the multi-mode symbol is in the passive mode. The processor 712 is further configured to randomly present 736 a triggering symbol(s) with a first symbol location on the symbol array, and establish 738 a connecting path(s) between the symbol location associated with the triggering symbol and a second symbol location that is populated with the multi-mode symbol. The processor 712 changes 740 the multi-mode symbol to operate in the active mode in response to the triggering symbol being presented and the connecting path being established, and further associates an updated symbol functionality with the multi-mode symbol in response thereto. The processor 712 identifies the payout enhancement award based on the updated symbol functionality, and applies the payout enhancement to a slot game event payout involving the second symbol location.

The foregoing description of the representative embodiments has been presented for the purposes of illustration and description. It is not intended to be exhaustive or to limit the invention to the precise form disclosed. Many modifications and variations are possible in light of the above teaching. For example, the present invention is equally applicable in electronic or mechanical gaming machines, and is also applicable to live table versions of gaming activities that are capable of being played in a table version (e.g., machines involving poker or card games that could be played via table games).

Some embodiments have been described above, and in addition, some specific details are shown for purposes of illustrating the inventive principles. However, numerous other arrangements may be devised in accordance with the inventive principles of this patent disclosure. Further, well known processes have not been described in detail in order not to obscure the invention. Thus, while the invention is described in conjunction with the specific embodiments illustrated in the drawings, it is not limited to these embodiments or drawings. Rather, the invention is intended to cover alternatives, modifications, and equivalents that come within the scope and spirit of the inventive principles set out above.

What is claimed is:

1. A slot game apparatus for enhancing gaming payouts in a slot game involving a succession of slot game events, comprising:

a display presenting a plurality of symbol locations forming a symbol array;

a user interface including at least one user input to enable a player to initiate a slot game event presented via the symbol array;

a wager input device structured to identify and validate player assets, and to permit the player to play the slot game event when the player assets are provided; and a processor configured to:

provide at least one multi-mode symbol having at least a passive mode and an active mode in connection with a slot game event;

associate a default symbol functionality with the multi-mode symbol when the multi-mode symbol is in the passive mode, wherein the default symbol functionality is as a default symbol defined in a paytable to provide a payout when a symbol combination involving the default symbol occurs;

randomly present at least one overlay symbol with a first one of the symbol locations on the symbol array that is not associated with the multi-mode symbol;

establish at least one connecting path between the symbol location associated with the overlay symbol and a second symbol location of the symbol array that is populated with the multi-mode symbol;

change the multi-mode symbol to operate in the active mode in response to the overlay symbol being presented and the connecting path being established, and associate an updated symbol functionality with the multi-mode symbol in response thereto; and identify a payout enhancement award based on the updated symbol functionality, and apply the payout enhancement to a slot game event payout involving the second symbol location.

2. The slot game apparatus of claim 1, wherein the processor is configured to establish the at least one connecting path by establishing a network of paths between a plurality of the symbol locations of the symbol array, including the second symbol location.

3. The slot game apparatus of claim 1, wherein the processor is configured to establish the at least one connecting path by expanding the at least one connecting path from a current one of the symbol locations to a new one of the symbol locations on each of the slot game events.

4. The slot game apparatus of claim 1, wherein the processor is configured to:

establish the at least one connecting path by expanding the at least one connecting path from a current one of the symbol locations to a new one of the symbol locations on each of the slot game events; and maintain the at least one multi-mode symbol on the symbol array during a plurality of the succession of slot game events, until the multi-mode symbol is operated in the active mode or until a termination event occurs.

5. The slot game apparatus of claim 1, wherein the processor is further configured to provide at least one linking symbol, and wherein the processor establishes the at least one connecting path in response to being positioned at the symbol location common to a position of the linking symbol.

* * * * *